United States Patent [19]

Casey et al.

[11] Patent Number: 4,951,878

[45] Date of Patent: Aug. 28, 1990

[54] PICO FUEL INJECTOR VALVE

[76] Inventors: Gary L. Casey, 3173 Roxbury, Troy, Mich. 48084; Robert A. McArthur, 57 E. New York St., Pontiac, Mich. 48055

[21] Appl. No.: 211,202

[22] Filed: Jun. 23, 1988

Related U.S. Application Data

[63] Continuation of Ser. No. 121,236, Nov. 16, 1987, abandoned.

[51] Int. Cl.[5] ..... B05B 1/30; F02M 61/18

[52] U.S. Cl. ..... 239/462; 137/549; 239/488; 239/585; 239/DIG. 19; 251/127; 251/129.15

[58] Field of Search ..... 239/585, 462, 488, 489, 239/124, 575, DIG. 19, DIG. 23; 251/118, 125, 127, 129.15, 129.21; 137/549, 550

[56] References Cited

U.S. PATENT DOCUMENTS

| | | | |
|---|---|---|---|
| 3,738,578 | 6/1973 | Farrell | 239/585 |
| 3,791,408 | 2/1974 | Saitou et al. | 251/129.15 |
| 3,884,195 | 5/1975 | Murtin et al. | 239/585 |
| 3,974,998 | 8/1976 | Wood | 251/129.15 |
| 4,212,277 | 7/1980 | Melotti et al. | 239/585 |
| 4,230,273 | 10/1980 | Claxton et al. | 239/489 |
| 4,393,994 | 7/1983 | Rieck | 251/129.15 |
| 4,394,973 | 7/1983 | Sauer et al. | 239/585 |
| 4,416,423 | 11/1983 | Krauss et al. | 239/585 |
| 4,532,906 | 8/1985 | Höppel | 239/585 |
| 4,552,311 | 11/1985 | Casey | 239/585 |
| 4,552,312 | 11/1985 | Ohno et al. | 239/585 |
| 4,643,359 | 2/1987 | Casey | 239/585 |
| 4,711,400 | 12/1987 | Radaelli et al. | 239/585 |
| 4,717,079 | 1/1988 | de Concini | 239/585 |

*Primary Examiner*—Andres Kashnikow
*Assistant Examiner*—Michael J. Forman
*Attorney, Agent, or Firm*—Russel C. Wells; George L. Boller

[57] ABSTRACT

A pico fuel injector valve (10) adapted to be received in an injector socket provided in an air intake manifold (12) of an internal combustion engine having an integral fuel rail (14). The fuel injector valve has a magnetically permeable cylindrical housing (26) having radial inlet ports (24) and an armature guide bore (32). A valve seat member (40) having an outlet port and a valve seat (48) is attached to the end of the cylindrical housing (26) having the guide bore. An orifice plate (56) having a calibrated orifice is disposed in an orifice plate recess (50) provided in the face of the valve seat member (40). A stator (76) disposed in the cylindrical housing has an axially disposed pole member (78) and a radial flange (80) attached to the other end of the cylindrical housing. A solenoid coil is wound directly around the pole member (78). An armature (34) is reciprocally disposed in the guide bore (32) and has a valve element provided on the face adjacent to the valve seat, a single annular seal (90) disposed intermediate the inlet ports (24) and the soleoid coil (86) is the only internal seal of the pico fuel injector valve. Electrical connection to the solenoid coil (86) is made through a pair of electrical terminals (94) extending external to the rear end of the pico fuel injector valve through the stator's radial flange (80).

65 Claims, 2 Drawing Sheets

PICO FUEL INJECTOR VALVE

This application is a continuation of application Ser. No. 121,236 filed Nov. 16, 1987 now abandoned.

BACKGROUND OF THE INVENTION

1. Field of the Invention

The invention is related to the field of fuel injector valves and in particular to a small size high speed electrically actuated fuel injector valve for internal combustion engines.

2. Description of the Prior Art

The current trend in internal combustion engine fuel control systems is to electronically compute the engine's fuel requirements and to provide to the engine the computed quantity of fuel through electrically actuated fuel injector valves. To date, the fuel injector valves still represent a limiting factor in the accuracy of the quantity of fuel being delivered. As a result, there is a concerted effort in the automotive industry to upgrade the performance capability of these fuel injector valves to improve their reliability and reduce their cost. Currently, most of the fuel injector valves used in the automotive industry are labor intensive requiring a relatively large number of machined parts having close tolerances and complex assembly and calibration procedures.

This problem was initially addressed in U.S. Pat. No. 4,552,311 which discloses a fuel injector valve specifically designed to reduce the number of machined parts. Subsequently, a miniature fuel injector valve design was disclosed in U.S. Pat. No. 4,643,359 which further reduced the number of parts which required precision machining, was easier to assemble, was easier to calibrate, and had superior high speed performance.

The present invention is a subminiature or pico fuel injector valve which is smaller than the miniature fuel injector valve disclosed in U.S. Pat. No. 4,643,359, has fewer parts requiring precision machining and has superior high speed performance characteristics.

SUMMARY OF THE INVENTION

The invention is a subminiature or pico injector valve having the full fuel delivery capability of the larger commercially available automotive fuel injector valves. The pico fuel injector valve is of the type having a magnetically permeable housing, a valve seat member, a stator, an armature, and an electrically actuated solenoid coil. The pico fuel injector valve is characterized by a magnetically permeable cylindrical housing having a central axis, a guide bore provided at one end thereof concentric with the central axis, and a plurality of fluid input ports radially disposed about the cylindrical housing adjacent to the internal end of the guide bore. The valve seat member is attached to the cylindrical housing at the end having the guide bore. The valve seat member has an outlet port provided therethrough concentric with the central axis of the cylindrical housing, a concentric orifice plate recess provided in the face opposite the cylindrical housing, and a valve seat on the face of the valve seat member adjacent to the cylindrical housing. An orifice plate is disposed in the orifice plate recess and has a calibrated orifice concentric with the outlet port. The stator has a radial flange attached to the other end of the cylindrical housing and a pole member extending axially from the radial flange towards the valve seat member. The pole member has one end attached to the radial flange and a free end. The armature is reciprocally disposed in the guide bore between the valve seat member and the pole member. The armature has a valve element engageable with the valve seat and a return spring bore. A return spring has one end disposed in the return spring bore and the other end engaging the free end of the pole member. The return spring produces a force biasing the armature towards the valve seat member and the valve element into engagement with the valve seat. Seal means are disposed in the cylindrical housing for providing a fluid tight seal between the plurality of fluid input ports and the solenoid coil.

The object of the present invention is to provide a small fuel injector valve for use in conjunction with internal combustion engines having fuel supply passageways integrated into the air intake manifold.

Another object of the present invention is to provide a small fuel injector valve having the same fuel delivery capabilities as the larger automotive fuel injector valves commercially available and also having superior high speed performance.

Another object of the present invention is to provide a fuel injector valve having a minimum number of elastomeric seals.

A final object of the present invention is to provide a fuel injector valve having a minimum of precision machined parts.

These and other objects of the present invention will become apparent from reading the detailed description of the invention in conjunction with the drawings.

DETAILED DESCRIPTION OF THE PREFERRED EMBODIMENT

Figure 1:
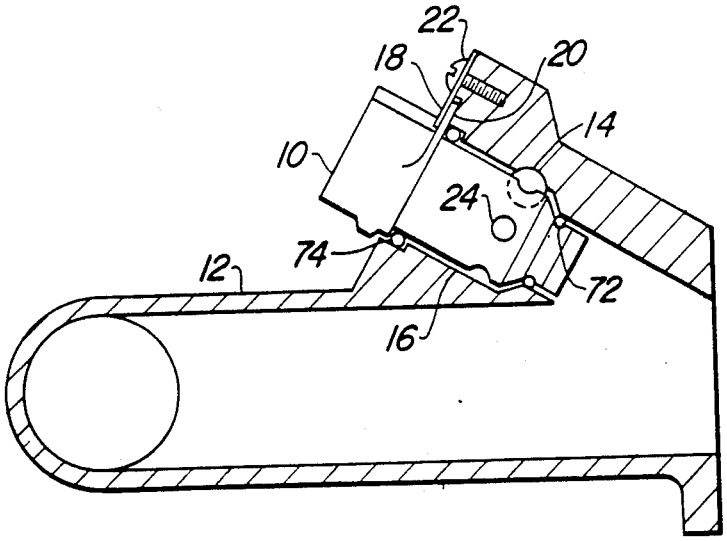
FIG. 1 is a cross-sectional side view showing the installation of the pico fuel injector valve in the intake manifold of an internal combustion engine having an integral fuel supply passageway.

FIG. 1 shows a pico fuel injector valve 10 installed in the air intake manifold 12 of an internal combustion engine having an integral fuel supply passageway 14. The pico fuel injector valve 10 is received in an injector socket 16 and is locked in place by an anchor plate 18 engaging a radial lip 20 protruding from the pico fuel injector valve 10. A fastener, such as a screw 22, secures the anchor plate to the intake manifold. The fuel is received by the pico fuel injector valve 10 through a series of inlet ports 24 disposed about its periphery in the vicinity of the integral fuel supply passageway 14. As in a conventional fuel injector system, a fuel pump (not shown) provides fuel to the integral fuel supply passageway 14 under pressure and a pressure regulator (not shown) controls the fuel pressure in the fuel supply passageway 14. "O" rings 72 and 74 form fluid tight seals between the pico fuel injector valve 10 and the internal walls of the injector socket 16 on opposite sides of the integral fuel supply passageway 14 to prevent fuel leakage into the air intake manifold 12 or externally to the air intake manifold.

Figure 2:
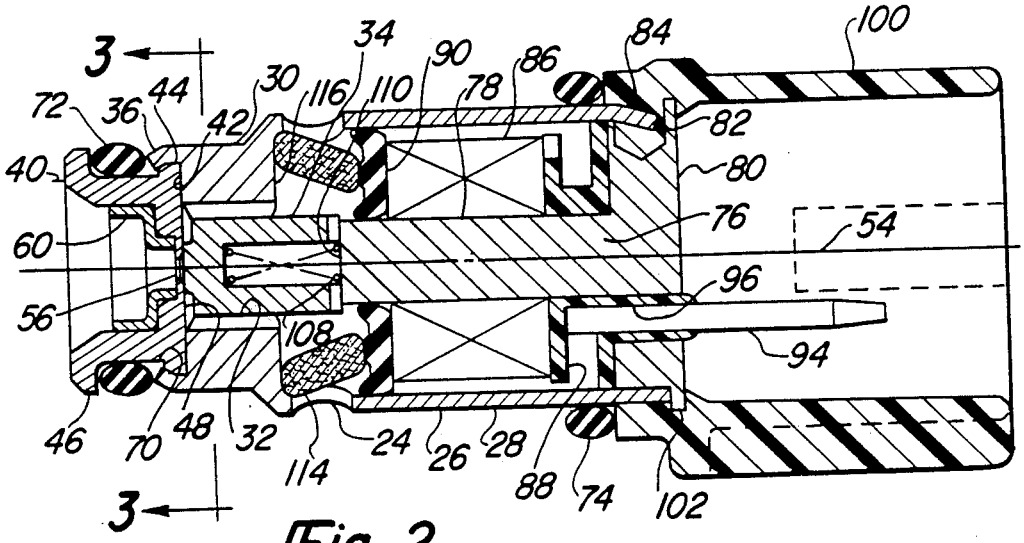
FIG. 2 is a cross-sectional side view of the pico fuel injector valve.

The details of the pico fuel injector valve 10 are shown in FIG. 2. The pico fuel injector valve 10 has a generally cylindrical housing 26 having a linear portion 28 and a necked down portion 30. The necked down portion 30 has an axial guide bore 32 which serves as a guide for an armature 34. The guide bore 32 extends along the length of the armature 34 a distance sufficient to prevent the armature from cocking in the guide bore. This reduces the friction between these elements and maintains the end face of the armature 34 perpendicular to the axis of the cylindrical housing. A counterbore 42 is provided at the end of the cylindrical housing 26 concentric with the guide bore 32. The bottom of the counterbore 42 forms a seat for a valve seat member 40. Preferably, the bottom of the counterbore 42 is ground at the same time as the internal surface of the guide bore 32 to assure that they are perpendicular to each other. The cylindrical housing 26 also has a plurality of inlet ports 24 as previously described, radially passing through the wall thereof adjacent to the necked down portion.

Figure 3:
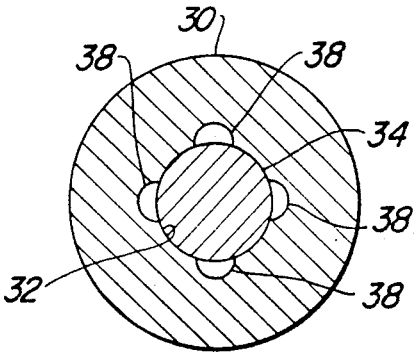
FIG. 3 is a cross-sectional view taken in the direction of sectional arrows 3—3 of FIG. 2 showing the location and shape of the fluid flow passages.
Figure 4:
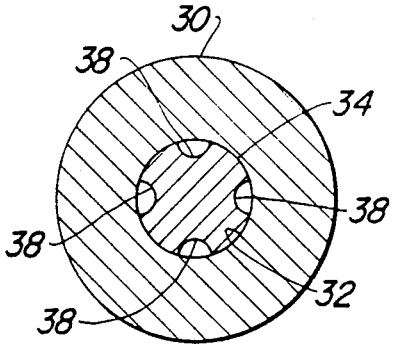
FIG. 4 is a cross-sectional view taken in the direction of the sectional arrows 3—3 of FIG. 2 showing the alternate location of the fluid flow passages.
Figure 5:
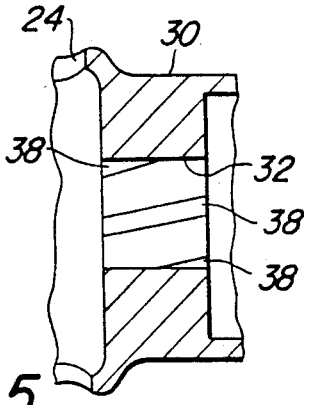
FIG. 5 is a partial cross-section side view of the cylindrical housing showing spiral fluid flow passages.

As more clearly shown in the cross-sectional view of FIG. 3, a plurality of fluid flow passages 38 are provided along the internal surface of the guide bore 32. Alternatively, as shown in FIG. 4, the fluid flow passages 38 may be provided in the external surface of the armature 34. As is well known in art, the fluid flow passages 38 may be parallel to the axis of the guide bore 32 as shown in FIG. 2 or may be spiral fluid flow passages as shown in FIG. 5. The spiral fluid flow passages impart a swirling motion to the fluid passing therethrough which increases the included angle of the spray cone exiting the pico fuel injector valve. Preferably, the cylindrical housing is made from a 400 series magnetic quality stainless steel, such as AISI 430 FR, and is screw machined from bar stock.

The valve seat member 40 is received in the counterbore 42 provided in the free end of the necked down portion 30 of the cylindrical housing 26. The valve seat member 40 is made from a magnetic stainless steel, such as AISI 440, and has a first radial flange 44 adjacent to the necked down portion 30 and a second radial flange 46 at the opposite end thereof. An end portion 36 of the cylindrical wall circumscribing the counterbore 42 is rolled over the first radial flange 44 as shown to lock the valve seat member 40 to the end of the cylindrical housing 26. The internal face of the valve seat member 40 adjacent to the armature 34 is lapped to form a flat valve seat 48. The lapped surface extends over the entire surface of the valve seat 48 and engages the seat formed at the bottom of the counterbore 42. This assures that the valve seat 48 is perpendicular to the guide bore 32. The fact that the lapped valve seat 48 also engages the seat formed at the bottom of the counterbore 42 is a unique feature of this fuel injector valve.

An orifice plate recess 50, in the form of a stepped well concentric with an axis 54 of the cylindrical housing 26, is provided in the valve seat member 40 on the side opposite the valve seat.

Figure 6:
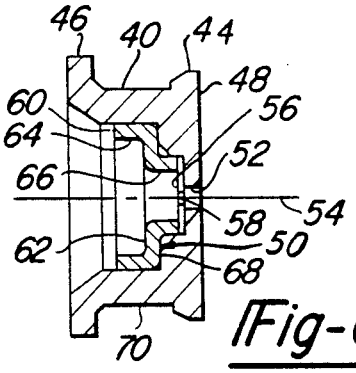
FIG. 6 is an isolated cross-sectional side view of the valve seat member.

As shown more clearly in FIG. 6, an outlet port 52 is provided through the bottom of the orifice plate recess 50 concentric with the axis 54 of the cylindrical housing. An orifice plate 56 having a calibrated orifice 58 concentric with the outlet port 52 is disposed at the bottom of the orifice plate recess 50 and is held in place by a retainer 60 pressed into the orifice plate recess. The diameter of the calibrated orifice 58 is selected to control the maximum fuel flow rate of the pico fuel injector valve when it is in its full open state. The retainer 60 has a radial section 62 which joins two concentric cylindrical sections 64 and 66, respectively. The radial section 62 seats on a shoulder 68 formed intermediate the top and bottom of the orifice plate recess 50. Preferably, the radial section 62 of the retainer 60 is flexible and functions as a spring holding the calibrated orifice plate 56 against the bottom of the orifice plate recess 50. This prevents distortion of the valve seat 48 when the retainer 60 is pressed into the orifice plate recess 50.

Returning to FIG. 2, the portion of the valve seat member 40 between the first and second radial flanges 44 and 46 respectively, forms an external circumferential "O" ring groove 70 which retains the first "O" ring 72. The first "O" ring 72 forms a fluid tight seal between the valve seat 40 of the pico fuel injector valve 10 and the internal wall of the injector socket 16 forward of the integral fuel supply passageway 14 as previously discussed relative to FIG. 1. The second "O" ring 74 as previously discussed forms a fluid tight seal between the cylindrical housing 26 and the internal surface of the injector socket 16 on the opposite side of the integral fuel supply passageway 14.

A stator 76 is disposed in the cylindrical housing 26. The stator 76 has a pole member 78 concentric with the axis of the cylindrical housing and an integral radial flange 80 enclosing the end of the cylindrical housing opposite the valve seat member 40. The radial flange 80 has a plurality of equally spaced radial bores 82 and a radial lip 102 which seats against the end of the cylindrical housing 26. Portions 84 of the cylindrical housing 26 which overlay the radial bores 82 are indented as shown in FIG. 2, to lock the stator 76 in the cylindrical housing. The stator 76 is made from a 400 series magnetic stainless steel, such as AISI 430 FR or sintered iron.

Figure 7:
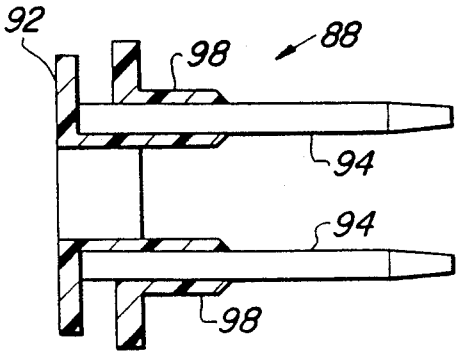
FIG. 7 is an isolated cross-sectional side view of the terminal bobbin.

A solenoid coil 86 is preferably wound directly on the pole member 78 of the stator 76, between a terminal bobbin 88 and an annular internal seal 90. The terminal bobbin 88 has a spool 92 and a pair of electrical terminals 94 as shown in FIG. 7, which provide electrical power to the solenoid coil 86. The electrical terminals 94 pass through a pair of mating apertures 96 provided through the stator's radial flange 80. The electrical terminals 94 are electrically insulated from the stator's radial flange by a pair of bosses 98 circumscribing the electrical terminals. These bosses 98 are formed integral with the spool 92 and extend through the apertures 96 of the radial flange. Alternatively, the solenoid coil 86 may be wound on a separate spool as is commonly done in the art.

An electrical connector housing 100 is molded to the end of the cylindrical housing 26 about the electrical terminals 94 to form the male portions of a commercially available electrical connector, such as Metri-Pack, 150 series connectors, manufactured by Packard Electric of Warren, Ohio.

The electrical connector housing 100 is made from a structural plastic such as glass filled nylon, and captivates the radial lip 102 of the stator's radial flange 80 to lock it to the rear end of the pico fuel injector valve. The structural plastic may also fill the radial bores 82 as shown in FIG. 2.

The annular internal seal 90 is made from a fuel resistant elastomer such as Buna N® or Vitron® and seals the gap between the pole member 78 and the internal surface of the cylindrical housing 26. The annular seal 90 is the only internal seal used in the pico fuel injector valve 10 and isolates the solenoid coil 86 and the terminal bobbin 88 from the fuel received through the inlet ports 24. This represents a significant reduction in the number of elastomeric seals compared to the number of internal seals used in the current commercially available fuel injector valves.

Figure 8:
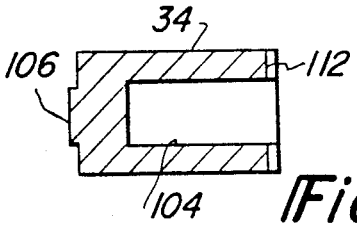
FIG. 8 is an isolated cross-sectional side view of the armature.

The armature 34 is made from a material having high magnetic permeable properties, such as soft iron or silicon iron. As shown in FIG. 8, the armature 34 has an axial return spring bore 104 and a valve element 106 in the form of a raised boss provided on the surface adjacent to the valve seat member 40. The diameter of the valve element 106 is larger than the diameter of the outlet port 52. The end face of the valve element 106 is perpendicular to cylindrical surface of the armature 34, and is preferably ground at the same time as the cylindrical surface to assure the perpendicularity of the two surfaces to each other. The end face of the valve element 106 is then lapped flat to form a fluid tight seal with the valve seat 48 of the valve seat member 40. It is to be noted that the sealing surface of the valve is determined by the diameter of valve element 106 and the diameter of the outlet port 52 provided through the valve seat member 40. This eliminates the need for a raised annulus type seat used with conventional flat valves.

The grinding of the bottom of the counterbore 42 perpendicular to the internal surface of the guide bore 32 and the grinding of the end face of the valve element 106 perpendicular to the external surface of the armature and the subsequent lapping of the valve seat 48 and the end face of the value element 106 result in a leakproof flat valve having lower manufacturing costs than any other known fuel injector valve.

Figure 9:
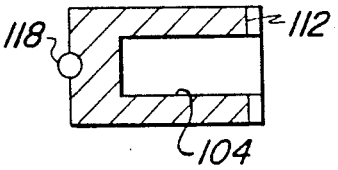
FIG. 9 is an isolated cross-sectional side view of an alternative embodiment of the armature.

Alternatively, a spherical valve seat member such as that formed by an embedded ball 118, may be provided at the end of the armature 34 as shown in FIG. 9 which would engage a conical valve seat (not shown) formed in the valve seat member 40.

A return spring 108 is disposed between the end face 110 of the pole member 78 and the bottom of the armature's return spring bore 104 and produces a force biasing the armature 34 towards the valve seat member 40 and the valve element 106 against the surface of the valve seat 48. Because the return spring 108 is disposed in the return spring bore 104, the forces are concentrated about the central axis 54 and near the end of the armature 34 adjacent to the valve seat 48. As a result, the radial and transverse forces produced by the return spring are significantly reduced assuring that the valve element 106 seats properly on the valve seat 48. The reduction of these radial and transverse forces also reduces the frictional forces between the armature 34 and the guide bore 32 of the cylindrical housing.

A relief slot 112 is provided in the face of the armature 34 facing the pole member 78 to provide a low resistance fluid path between the armature 34 and the stator 76. This permits the fluid to rapidly fill the increased volume between the stator and the armature when the armature is displaced to engage the valve seat 48 by the return spring 108 and to rapidly be expelled by the decreased volume between the armature 34 and the stator 76 when the solenoid coil 86 is energized.

The armature 34 is coated with hard, noncorrosive, non-magnetic, low friction material to reduce the friction and wear between the armature 34 and the internal surface of the guide bore 32 and the damage due the hammering of the armature's valve element 106 against the lapped valve seat 48. The adjacent end surfaces of the armature 34 and the stator 76 are also coated with a hard, noncorrosive, nonmagnetic, low friction material. Preferably, the hard coating is a ceramic, such as titanium nitride, titanium carbide or similar material. However, chrome or electroless nickle are satisfactory alternative materials. The nonmagnetic coating on the adjacent faces of the armature 34 and the stator 76 functions as a nonmagnetic spacer between these two elements which inhibits residual magnetic fields in both the armature and stator from delaying the return of the armature to the valve seat 48 by the return spring 108 after the electrical signal to the solenoid coil is terminated. These nonmagnetic coatings reduce the closing time of the pico fuel injector valve 10 and make the closing time more consistent.

The diameter of the armature 34 is intentionally made larger than the diameter of the stator's pole member 78 to increase the armatures response to the magnetic field emanating from the end of the stator 76. The increased diameter of the armature 34 allows it to capture some of the magnetic flux leaking from the end of the stator's pole member, thereby increasing the attractive force exerted between the armature and the stator's pole member 78.

A fuel filter 114 is disposed between the internal face 116 of the necked down portion 30 of the cylindrical housing 26 and the annular seal 90. The fuel filter may be cylindrical or conical as shown in FIG. 2. The fuel filter 114 not only filters the fuel as it enters the pico fuel injector valve 10 from the integral fuel rail 14 but also produces a resilient force biasing the annular seal 90 against the solenoid coil 86. The fuel filter 114 may be made from a plastic foam, metal or glass fibers, or may be a metal mesh screen.

In the manufacture of the pico fuel injector valve, the displacement distance of the armature 34 in response to energizing the solenoid coil 86 is precisely controlled. Knowing the length of the armature, the distance between the stator's radial lip 102 and the face 110 of the pole member 78, a cylindrical housing having an appropriate distance between the free end of the linear portion 28 and the seat formed at the bottom of the counterbore 42 may be selected or corrected to give the desired spacing between the armature 54 and the stator 76. Alternatively, a spacer may be placed between the valve seat member 40 and the seat formed at the bottom of the counterbore 42 to obtain the proper displacement of the armature 34 in response to energizing the solenoid coil.

The advantages of the pico fuel injector valve are as follows:

1. Significantly lower cost than any commercially available designs through the elimination of costly machined parts.
2. The use of flat valves and flat valve seats to eliminate precise concentricity requirements.

3. The valve has only one internal seal.
4. There is sufficient space for an internal fuel filter.
5. Compared to conventional fuel injector valves for automotive vehicles the pico fuel injector valve is extremely small. Excluding the electrical connector housing molded to the end of the cylindrical housing, the pico fuel injector valve is only 24 mm (0.94 inches) long and has a diameter of only 11.4 mm (0.45 inches).
6. The pico fuel injector valve also has superior performance characteristics exhibiting linear fuel delivery for electrical signals having pulse widths of less than 1 millisecond.

Having described the pico fuel injector valve in detail, it is submitted that one skilled in the art will be able to make certain changes in the structure illustrated in the drawings and described in the specification without departing from the spirit of the invention as set forth in the appended claims.

What is claimed is:

1. In a fluid injector valve of the type having a magnetically permeable housing, a valve seat, a stator, an armature, and an electrically actuated solenoid coil for generating a magnetic field operative to displace the armature from the valve seat, characterized by:

a magnetically permeable cylindrical housing having a central axis, a guide bore provided at one end thereof concentric with said central axis and a plurality of fluid inlet ports radially disposed about said cylindrical housing adjacent to an internal end of said guide bore;

a valve seat member attached to said one end of said cylindrical housing, said valve seat member having an outlet port provided therethrough concentric with said central axis, a concentric orifice plate recess provided in the face of said valve seat member opposite said cylindrical housing, and a valve seat circumscribing said outlet port on the face opposite said orifice plate recess;

an orifice plate attached to the bottom of said orifice plate recess, said orifice plate having a calibrated orifice concentric with said outlet port;

a stator having a radial flange attached to the other end of said cylindrical housing and having a pole member extending axially from said radial flange towards said valve seat member, said pole member having one end attached to said radial flange and a free end;

solenoid coil means circumscribing said pole member;

a cylindrical armature reciprocally disposed in said guide bore between said valve seat member and said free end of said pole member said armature having a valve element engageable with said valve seat and a return spring bore;

a return spring compressively disposed between said armature and said free end of said pole member, said return spring received in said return spring bore and producing a force biasing said armature towards said valve seat member and said valve element into engagement with said valve seat; and seal means disposed in said cylindrical housing for providing a fluid tight seal between said plurality of fluid inlet ports and said solenoid coil.

2. The fuel injector valve of claim 1 wherein the mating surfaces of said valve seat and said valve element are flat surfaces.

3. The fuel injector valve of claim 2 wherein said valve element of said armature is a raised boss having an end face which has a diameter larger than the diameter of said outlet port and said flat surface is provided on said end face of said raised boss.

4. The fuel injector valve of claim 3 wherein at least the cylindrical surface of said armature and said end face of said raised boss are coated with a hard, noncorrosive, nonmagnetic, low friction material.

5. The fuel injector valve of claim 4 wherein said hard, noncorrosive, nonmagnetic, low friction material is a ceramic.

6. The fuel injector valve of claim 4 wherein said hard, noncorrosive, nonmagnetic, low friction material is a metal.

7. The fuel injector valve of claim 1 wherein said valve seat is a conical surface and said valve element is a spherical surface protruding from the end of said armature concentric with said conical surface of said valve seat.

8. The fuel injector valve of claim 1 wherein said solenoid coil means comprises a-solenoid coil wound directly on said pole member and a terminal bobbin disposed intermediate said solenoid coil and said radial flange, said terminal bobbin having an electrically nonconductive spool and a pair of terminals electrically connected to the opposite ends of said solenoid coil, said pair of terminals extending from said spool parallel to said central axis through a mating pair of apertures provided in said radial flange.

9. The fuel injector valve of claim 8 including an electrical connector housing attached to the end of said cylindrical housing which circumscribes said pair of electrical terminals extending through said radial flange.

10. The fuel injector valve of claim 9 wherein said valve seat member has an external circumferential "O" ring groove.

11. The fuel injector valve of claim 10 having a first "O" ring retained in said circumferential "O" ring groove and a second "O" ring circumscribing said cylindrical housing adjacent to said electrical connector housing.

12. The fuel injector valve of claim 8 having means for electrically insulating said pair of electrical terminals from said radial flange as they extend through said mating apertures.

13. The fuel injector valve of claim 12 wherein said means for electrically insulating said pair of electrical terminals is a pair of bosses formed integral with said spool filling the space between said terminals and the internal walls of said mating apertures.

14. The fuel injector valve of claim 1 having at least one fluid passageway provided along the length of said guide bore to permit fuel to flow freely from said inlet ports to said outlet port when said armature is magnetically attracted to said stator.

15. The fuel injector valve of claim 14 wherein said at least one fluid passageway is a plurality of linear fluid passageways provided in the walls of said guide bore.

16. The fuel injector valve of claim 14 wherein said at least one fluid passageway is a plurality of spiral passageways provided in the walls of said guide bore.

17. The fuel injector valve of claim 14 wherein said at least one fluid passageway is a plurality of linear passageways provided in the external surface of said armature.

18. The fuel injector valve of claim 14 wherein said at least one fluid passageway is a plurality of spiral passageways provided in the external surface of said armature.

19. The fuel injector valve of claim 1 further comprising:

an "O" ring groove circumscribing said valve seat member;

a first "O" ring disposed in said "O" ring groove; and a second "O" ring circumscribing said cylindrical housing at a location intermediate said inlet ports and the end of said cylindrical housing opposite said valve seat member.

20. A fuel injector valve comprising:

a magnetically permeable cylindrical housing having a coaxial guide bore provided at one end extending a predetermined distance along the length of said cylindrical housing and at least one radially disposed inlet port provided adjacent to the internal end of said coaxial guide bore;

a valve seat member attached to said one end of said cylindrical housing, said valve seat member having an outlet port passing therethrough concentric with the axis of said cylindrical housing, a valve seat provided in the face of said valve seat member facing said cylindrical housing concentric with said outlet port, and an orifice plate recess concentric with said outlet port provided in the face of said valve seat member opposite said cylindrical housing;

an orifice plate attached to said valve seat member at the bottom of said orifice plate recess, said orifice plate having a calibrated orifice concentric with said outlet port;

a stator disposed in said cylindrical housing, said stator having a pole member extending coaxially towards said coaxial guide bore and a radial flange attached to the other end of said cylindrical housing, said pole member having one end attached to said radial flange and a free end;

solenoid coil means circumscribing said pole member;

a magnetically susceptible cylindrical armature reciprocally disposed in said coaxial guide bore between said valve seat member and said pole member; said armature having, at one end thereof, a valve element engageable with said valve seat and an axial return spring bore at the other end;

a return spring having one end disposed in said return spring bore and the other end engaging said free end of said pole member producing a force biasing said armature towards said valve seat member;

a fluid passageway providing a fluid path between said at least one radially disposed inlet port and said one end of said armature; and an annular seal disposed in said cylindrical housing intermediate said at least one radially disposed inlet port and said solenoid coil means, said annular seal forming a fluid tight seal between the external surface of said pole member and the internal surface of said cylindrical housing.

21. The fuel injector valve of claim 20 wherein said valve seat and said valve element have mating flat surfaces.

22. The fuel injector valve of claim 21 wherein said mating flat surfaces are lapped surfaces.

23. The fuel injector valve of claim 21 wherein said valve element is a raised boss having an end face and a diameter larger than said outlet port, said mating flat surface of said valve element is said end face of said raised boss.

24. The fuel injector valve of claim 23 wherein at least the cylindrical surface of said armature and said end face of said raised boss are coated with a hard, noncorrosive, nonmagnetic, low friction material.

25. The fuel injector valve of claim 24 wherein said hard, noncorrosive, nonmagnetic, low friction material is a ceramic.

26. The fuel injector valve of claim 24 wherein said hard, noncorrosive, nonmagnetic, low friction material is a metal.

27. The fuel injector valve of claim 20 wherein said valve seat is a conical surface, said valve element is a spherical surface protruding from the end of said armature concentric with said conical surface.

28. The fuel injector valve of claim 20 wherein said fluid passageway is at least one linear fluid passageway provided in the internal surface of said guide bore.

29. The fuel injector valve of claim 20 wherein said fluid passageway is at least one spiral passageway provided in the internal surface of said guide bore.

30. The fuel injector valve of claim 20 wherein said fluid passageway is at least one linear passageway provided in the external surface of said armature.

31. The fuel injector valve of claim 20 wherein said fluid passageway is at least one spiral passageway provided in the external surface of said armature.

32. The fuel injector valve of claim 20 wherein said valve seat member has an external circumferential "O" ring groove.

33. The fuel injector of claim 32 having:

a first "O" ring retained in said external circumferential "O" ring groove; and a second "O" ring circumscribing said cylindrical housing intermediate said at least one radially disposed inlet port and said other end of said cylindrical housing.

34. The fluid injector of claim 20 wherein said solenoid coil means comprises:

a solenoid coil wound directly on said pole member intermediate said one end attached to said radial flange and said free end; and a terminal bobbin disposed between said solenoid coil and said radial flange, said terminal bobbin having a nonconductive spool member circumscribing said pole member and a pair of electrical terminals electrically connected to the opposite ends of said solenoid coil, said electrical terminals extending from said spool member parallel to the axis of said cylindrical housing through a mating pair of apertures provided through said radial flange.

35. The fuel injector valve of claim 34 wherein said spool includes an insulator boss circumscribing each of said electrical terminals, said insulator bosses extending along said electrical terminals a distance equal to at least the length of said mating apertures through said radial flange to electrically insulate said electrical terminals from said radial flange.

36. The fuel injector valve of claim 34 including an electrical connector housing attached to the end of said cylindrical housing which circumscribes said pair of electrical terminals extending through said radial flange.

37. A small fuel injector valve for use in an internal combustion engine having a fuel rail integral with an air intake manifold and injector valve sockets provided in the air intake manifold for receiving a fuel injector valve, said small fuel injector valve comprising:

a magnetically permeable cylindrical housing having, at one end, a coaxial guide bore extending a predetermined distance along the length of said cylindrical housing and at least one radially disposed inlet port for receiving fuel from said integral fuel rail, said at least one radially disposed inlet port being disposed intermediate the internal end of said coaxial guide bore and the other end of said cylindrical housing;

a valve seat member attached to said one end of said cylindrical housing, said valve seat member having an external circumferential "O" ring groove, an outlet port provided therethrough concentric with the axis of said cylindrical housing, a valve seat circumscribing said outlet port provided on the face of said valve seat member adjacent to said cylindrical housing, and an orifice plate recess concentric with said outlet port provided on the face of said valve seat member opposite said valve seat;

an orifice plate disposed in the bottom of said orifice plate recess having a calibrated orifice concentric with said outlet port;

a retainer for locking said orifice plate in the bottom of said orifice plate recess;

a stator concentrically disposed in said cylindrical housing, said stator having a radial flange attached to the other end of said cylindrical housing and a pole member extending from said radial flange towards said coaxial guide bore concentric with the axis of said cylindrical housing, said pole member having one end attached to said radial flange and a free end, said radial flange having a pair of terminal apertures provided therethrough;

a solenoid coil circumscribing said pole member intermediate said radial flange and said free end;

a terminal bobbin circumscribing said pole member between said solenoid coil and said radial flange, said terminal bobbin having a pair of electrical terminals electrically connected to the opposite ends of said solenoil coil, said electrical terminals extending through said terminal apertures and protruding externally beyond said radial flange;

an electrical connector housing attached to said other end of said cylindrical housing which circumscribes the portion of said electrical terminals protruding externally from said radial flange;

a magnetically permeable cylindrical armature reciprocally disposed in said coaxial guide bore between said valve seat member and said free end of said pole member, said armature having at one end thereof, a valve element engageable with said valve seat, to form a fluid tight seal, and an axial return spring bore at the other end;

a return spring having one end disposed in said axial return spring bore and the other end engaging said free end of said pole member producing a force biasing said armature towards said valve seat member;

a fluid passageway providing a fluid path between said at least one radially disposed inlet port and said one end of said armature;

an annular seal disposed in said cylindrical housing intermediate said at least one radially disposed inlet port and said solenoid coil, said annular seal forming a fluid tight seal between the external surface of said pole member and the internal surface of said cylindrical housing to prevent fuel from deteriorating the solenoid coil or leaking through said terminal apertures;

a first "O" ring disposed in said external circumferential "O" ring groove provided in said valve seat member, said first "O" ring providing a fluid tight seal between said valve seat member and the internal walls of said injector socket valve between said integral fuel rail and the interior of said air intake manifold; and a second "O" ring disposed about the external surface of said cylindrical housing intermediate said at least one inlet port and said other end of said cylindrical housing, said second "O" ring providing a fluid tight seal between said cylindrical housing and the internal surface of said injector socket valve intermediate said integral fuel rail and said other end of said cylindrical housing.

38. The fuel injector valve of claim 37 wherein said valve seat and said valve element have mating flat surfaces.

39. The fuel injector valve of claim 38 wherein said mating flat surfaces are lapped.

40. The fuel injector valve of claim 38 wherein said valve element is a raised boss protruding from said one end of said armature concentric with said outlet port, said raised boss having an end face the diameter of which is larger than said outlet port and said mating flat surface is said end face of said raised boss.

41. The fuel injector valve of claim 40 wherein at least said end face of said valve element and the cylindrical surface of said armature are coated with a hard, noncorrosive, nonmagnetic, low friction material.

42. The fuel injector valve of claim 41 wherein said hard, noncorrosive, nonmagnetic, low friction material is a ceramic.

43. The fuel injector valve of claim 41 wherein said hard, noncorrosive, nonmagnetic, low friction material is a metal.

44. The fuel injector of claim 37 having a fuel filter disposed in said cylindrical housing between said at least one inlet port and said fluid passageway.

45. The fuel injector of claim 44 wherein said cylindrical housing has an annular shoulder formed at the internal end of said coaxial guide bore, said fuel filter being disposed between said annular shoulder and said annular seal.

46. The fuel injector of claim 37 wherein said electrical connector housing provides a raised "O" ring seat for said second "O" ring adjacent to the end of said cylindrical housing.

47. The fuel injector of claim 37 wherein said electrical connector housing has a lip engageable by an anchor plate attached to said air intake manifold to hold said fuel injector valve in said injector valve socket.

48. A fluid injector valve comprising:

a magnetically permeable cylindrical housing including a central axis, a guide bore integral with said housing and at one end thereof concentric with said central axis and at least one inlet port in communication with the guide bore;

a valve seat member attached to said one end of said cylindrical housing, including a flow port facing and in communication with the guide bore concentric with said central axis, an orifice plate recess concentric with the flow port, and a valve seating surface circumscribing said flow port on a face thereof opposite said orifice plate recess;

a thin flat orifice plate wholly received within said orifice plate recess, said thin orifice plate including an orifice concentric with the flow port;

a stator including a pole member including a free end extending toward the valve seat;

solenoid coil means circumscribing said pole member for generating a magnetic field;

a cylindrical, magnetically attractable armature reciprocally disposed in said guide bore between said valve seat and said free end of said pole member, including a valve element, engageable with said valve seat;

a return spring compressively disposed between said armature and said free end of said pole member, and producing a force biasing said armature towards said valve seat member and said valve element into engagement with said valve seat; and seal means disposed in said cylindrical housing for providing a fluid tight seal between said inlet port and said solenoid coil means.

49. The injector as defined in claim 48 wherein the diameter of the armature is greater than the diameter of the pole member.

50. A fluid injector valve comprising:

a magnetically permeable cylindrical housing including a central axis, a guide bore integral with said housing and proximate one end thereof concentric with said central axis and at least one inlet port in communication with the guide bore;

a valve seat member attached to said one end of said cylindrical housing including a flow port facing the guide bore concentric with said central axis, an orifice plate recess concentric with the flow port, and a valve seating surface circumscribing said flow port on a face opposite said orifice plate recess;

a thin flat orifice plate wholly received within said orifice plate recess, said thin orifice plate including an orifice concentric with the flow port;

solenoid coil means for generating a magnetic field;

a cylindrical, magnetically attractable armature reciprocally disposed in said guide bore including a valve element engageable with said valve seating surface;

a stator concentric with said central axis and aligned with said armature opposite said valve seat member;

a return spring compressively loading said armature for producing a force biasing said armature towards said valve seat member and said valve element into engagement with said valve seat; and seal means disposed in said cylindrical housing for providing a fluid tight seal between said inlet port and a solenoid coil.

51. The injector as defined in claim 50 wherein the housing includes an annular surface disposed about an exit end of the guide bore, remote from the inlet port, said annular surface is flat and perpendicular to the guide bore.

52. The injector as defined in claim 51 wherein said opposite face of the valve seat member abuts said annular surface of the housing and is substantially flat thereacross and parallel to said annular surface.

53. The injector as defined in claim 52 wherein said valve element engages a portion of said valve seating surface proximate said flow port, said valve element comprises a substantially flat surface perpendicular to the cylindrical outer wall of said armature.

54. The injector as defined in claim 50 wherein said armature, at an end thereof that engages the pole member includes fluid relief means for preventing fluid becoming trapped between said armature and stator when said armature and stator are magnetically attracted.

55. The injector as defined in claim 54 wherein the fluid relief means includes at least one slot perpendicular to the axis of said armature and located in the engagement end of said armature.

56. The injector as defined in claim 50 wherein the diameter of the armature is greater than the diameter of the pole member.

57. A fluid injector valve comprising:

a housing having a central axis and defining a fuel receiving chamber an inlet port communicating with the chamber and a fluid exit end;

a valve seat member, disposed at said fluid exit end of said housing, including an orifice plate recess concentrically disposed relative to said central axis, a substantially flat valve seat opposite from the orifice plate recess and a flow port joining the bottom of the orifice plate recess with the valve seat;

a thin flat orifice plate wholly received within the bottom of the orifice plate recess comprising an orifice substantially concentric with the flow port;

armature means comprising a substantially flat valve element for engaging the valve seat and for opening and closing the flow port so that fuel can flow therethrough; and means for supplying fluid proximate the valve element and for moving the armature relative to the valve seat.

58. A fluid injector comprising:

a housing defining a fuel receiving chamber and an inlet port communicating with the chamber;

a stator disposed within the housing including a pole member extending axially and having an end face in the fuel receiving chamber;

a coil circumscribing the pole member;

an annular disk shaped seal means disposed in the housing, including a first face defining a wall of the fluid receiving chamber and a second face directly abutting the coil for defining a fluid tight seal among the coil, the housing and the pole member;

filter means disposed with the fuel receiving chamber for filtering fluid and for engageably urging said seal means against the coil; and armature means, disposed internal of the filter means and movable relative to the end face of the stator and a flow port in response to a magnetic force for opening and closing the flow port.

59. The fuel injector as defined in claim 58 wherein said seal means is expandable radially inwardly about the pole member and outwardly toward an inner wall of the housing when subject to compressive loading forces.

60. The injector as defined in claim 58 wherein an end of the said filter means compressively engages the first face of said seal means between an inner circumferential lip engaging the pole member and an outer circumferential lip engaging the housing.

61. The injector as defined in claim 60 wherein said seal means between the inner and outer lips includes a ring such that when subjected to compressive loading enhances the expansion of said seal means radially inwardly and outwardly.

62. The injector as defined in claim 61 wherein the inner and outer lips taper inwardly such that when subjected to a pressure force generated by pressurized fluid in the chamber a radial component of pressure force acts upon the lips to further urge same against the circumferential housing and pole member.

63. The injector as defined in claim 62 wherein said first face of said seal means further includes a ring, situated between the inner and outer lips and where the filter means compressively engages said seal means proximate the ring.

64. The injector as defined in claim 58 wherein housing includes a cylindrical guide bore, the armature is cylindrical, axially movable between the flow port and the end face of the pole member and movably guided within and radially stabilized by the guide bore.

65. The injector as defined in claim 64 wherein the outer diameter of the armature is larger than the diameter of the end face of the pole member.

* * * * *